US007654732B2

(12) United States Patent
Burton et al.

(10) Patent No.: US 7,654,732 B2
(45) Date of Patent: Feb. 2, 2010

(54) TIMEPIECE INCORPORATING WRISTBAND CONTACT ELEMENTS

(75) Inventors: Maximillian P. Burton, Portland, OR (US); Hamid Arjomand, Tigard, OR (US); Brad N. Clarkson, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/848,485

(22) Filed: Aug. 31, 2007

(65) Prior Publication Data

US 2009/0059735 A1 Mar. 5, 2009

(51) Int. Cl.
*G04B 37/00* (2006.01)

(52) U.S. Cl. ..... 368/282; 224/173

(58) Field of Classification Search ..... 368/282; 63/3.1; 224/165–179, 164, 173, 219; 24/3.2, 24/41.1–48, 265 WS See application file for complete search history.

(56) References Cited

U.S. PATENT DOCUMENTS

| | | | | |
|---|---|---|---|---|
| 2,184,060 | A | 12/1939 | Singer | |
| 2,189,096 | A | 2/1940 | Alonge | |
| 2,189,098 | A | 2/1940 | Alonge | |
| D119,638 | S | 3/1940 | Ornstein | |
| D119,639 | S | 3/1940 | Ornstein | |
| 2,328,785 | A | 9/1943 | Cozarl | |
| 2,342,804 | A | 2/1944 | Miller | |
| 2,344,136 | A | 3/1944 | Dressen | |
| 2,513,892 | A | 7/1950 | Pile | |
| 2,519,892 | A | 7/1950 | Pill | |
| 2,553,089 | A | 8/1951 | Holder | |
| 3,149,452 | A | 9/1964 | Smith | |
| 3,492,809 | A * | 2/1970 | Gisiger-Lusa Armin | 368/282 |
| 4,023,347 | A | 5/1977 | Haber | |
| D245,766 | S | 9/1977 | Cruse | |
| 4,178,751 | A | 12/1979 | Liautaud | |
| 4,229,936 | A | 10/1980 | Schneider et al. | |
| D267,077 | S | 11/1982 | Kabaya | |
| 4,627,739 | A | 12/1986 | Shingo et al. | |
| D297,622 | S | 9/1988 | Lee | |
| 4,879,702 | A | 11/1989 | Gardner | |
| 5,020,039 | A | 5/1991 | Yokote | |
| D325,174 | S | 4/1992 | Bulgari | |
| D337,739 | S | 7/1993 | Robert-Tissot | |
| 5,235,567 | A * | 8/1993 | Goodwin | 368/282 |
| D340,192 | S | 10/1993 | Robert-Tissot | |
| D340,647 | S | 10/1993 | Robert-Tissot | |
| 5,341,552 | A * | 8/1994 | Voumard | 29/896.33 |
| D356,269 | S | 3/1995 | Milovanovic | |
| D361,282 | S | 8/1995 | Bulgari | |
| D361,524 | S | 8/1995 | Bulgari | |
| D363,893 | S | 11/1995 | Avakian | |
| D365,550 | S | 12/1995 | Houlihan | |
| D366,036 | S | 1/1996 | Houlihan | |
| 5,638,342 | A | 6/1997 | Kartsotis et al. | |
| D388,333 | S | 12/1997 | Wunderman | |

(Continued)

*Primary Examiner*—Vit W Miska
*Assistant Examiner*—Sean Kayes
(74) *Attorney, Agent, or Firm*—Plumsea Law Group, LLC

(57) ABSTRACT

A wrist-worn timepiece may have a case, a timing element, a wristband, and a contact element. The timing element is located within the case. The wristband extends outward from the case and defines an aperture. The contact element is secured to the wristband and has an outer portion and a locking portion. The outer portion forms a portion of an exterior surface of the timepiece and is located to contact a wrist of a wearer. The outer portion is also formed of a first material. The locking portion is joined with the outer portion and positioned to contact an edge of the aperture. The locking portion is also formed of a second material.

27 Claims, 19 Drawing Sheets

U.S. PATENT DOCUMENTS

| | | | | |
|---|---|---|---|---|
| D396,651 | S | 8/1998 | Wunderman | |
| D398,247 | S | 9/1998 | Dumas | |
| 5,812,500 | A | 9/1998 | Webb, Jr. | |
| D400,118 | S | 10/1998 | Itzkowitz | |
| D404,316 | S | 1/1999 | Azegami et al. | |
| D404,655 | S | 1/1999 | Azegami | |
| D413,070 | S | 8/1999 | Charriol | |
| D415,708 | S | 10/1999 | Yanku | |
| D418,442 | S | 1/2000 | Yanku | |
| D429,168 | S | 8/2000 | Jannard et al. | |
| D430,495 | S | 9/2000 | Wunderman | |
| D433,342 | S | 11/2000 | Fox | |
| D434,333 | S | 11/2000 | Riley et al. | |
| D434,674 | S | 12/2000 | Shiraishi | |
| D435,461 | S | 12/2000 | So | |
| D438,123 | S | 2/2001 | Choi et al. | |
| D438,470 | S | 3/2001 | Choi et al. | |
| D439,527 | S | 3/2001 | Kennedy | |
| D440,885 | S | 4/2001 | Streltsov | |
| 6,216,490 | B1 | 4/2001 | Radley-Smith | |
| D441,663 | S | 5/2001 | Streltsov | |
| 6,238,083 | B1 * | 5/2001 | Hirano et al. | 368/282 |
| D446,461 | S | 8/2001 | Wunderman | |
| D447,426 | S | 9/2001 | Jannard et al. | |
| D447,700 | S | 9/2001 | Glauser | |
| D448,682 | S | 10/2001 | Sato | |
| D449,997 | S | 10/2001 | Allen et al. | |
| D450,600 | S | 11/2001 | Scarinzi | |
| D451,036 | S | 11/2001 | Zuckerman et al. | |
| 6,499,875 | B1 | 12/2002 | Telly | |
| 6,728,166 | B2 | 4/2004 | Grupp | |
| 2005/0162984 | A1 * | 7/2005 | Wilson | 368/281 |

* cited by examiner

TIMEPIECE INCORPORATING WRISTBAND CONTACT ELEMENTS

BACKGROUND

A conventional wrist-worn timepiece (i.e., a watch) may be structured to perform both aesthetically and functionally during a variety of activities. Dress watches, for example, are designed to have a fashionable appearance appropriate for business or social gatherings. Diving watches are designed to be particularly durable and water-resistant in order to withstand the high-pressure environments often encountered by scuba divers. In addition, sport watches are designed to be lightweight and worn by athletes during athletic training or competitions.

The components of a conventional watch generally include a timing element, a case, and a wristband. The timing element is located within the case and primarily functions to display time in either an analog or digital format. The case protects the timing element and often includes a transparent crystal for viewing the time or other information displayed on the timing element. The wristband extends from opposite sides of the case and secures the case and timing element to a wrist of an individual.

Although a majority of watches include a timing element, case, and wristband, modern watch designs include many variations upon these components. For example, the timing element may incorporate mechanical, electrical, or a combination of mechanical and electrical components. In addition to displaying time, the timing element may function as a chronograph, count-down timer, alarm, lap counter, calculator, thermometer, heart-rate monitor, altimeter, or global positioning system device, for example. Materials forming the case may be a polymer or a metal, and the crystal may be formed from a polymer, glass, or sapphire crystal, for example. Furthermore, the wristband may be formed from a metal, a polymer, or leather, and the wristband may have a clasp that secures the watch to the wrist or an open, bracelet-type configuration.

SUMMARY

A wrist-worn timepiece may have a case, a timing element, a wristband, and a contact element. The timing element is located within the case. The wristband extends outward from the case and defines an aperture. The contact element is secured to the wristband and has an outer portion and a locking portion. The outer portion forms a portion of an exterior surface of the timepiece and is located to contact a wrist of a wearer. The outer portion is also formed of a first material. The locking portion is joined with the outer portion and positioned to contact an edge of the aperture. The locking portion is also formed of a second material.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
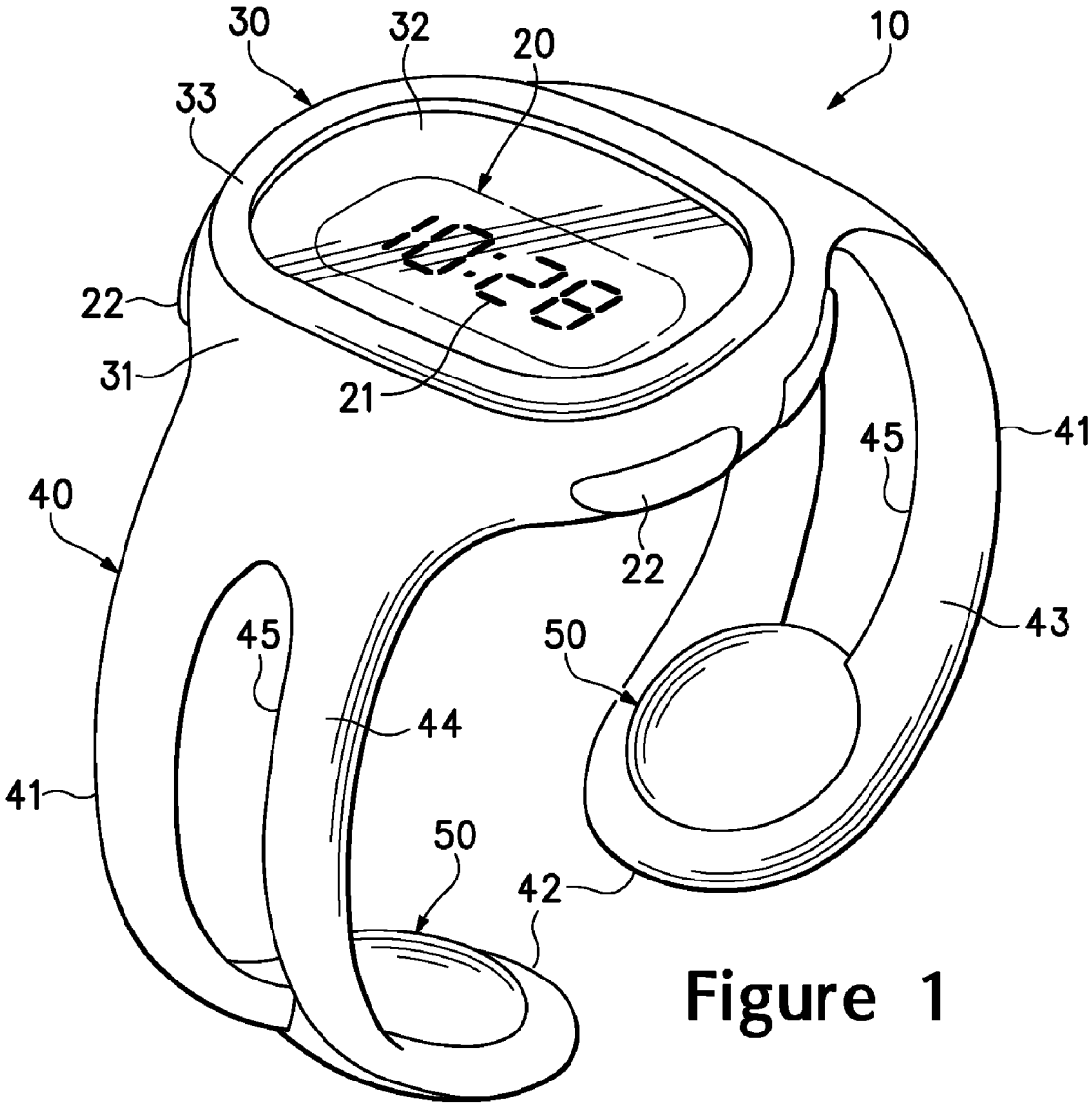
FIG. 1 is a perspective view of a wrist-worn timepiece.
Figure 2:
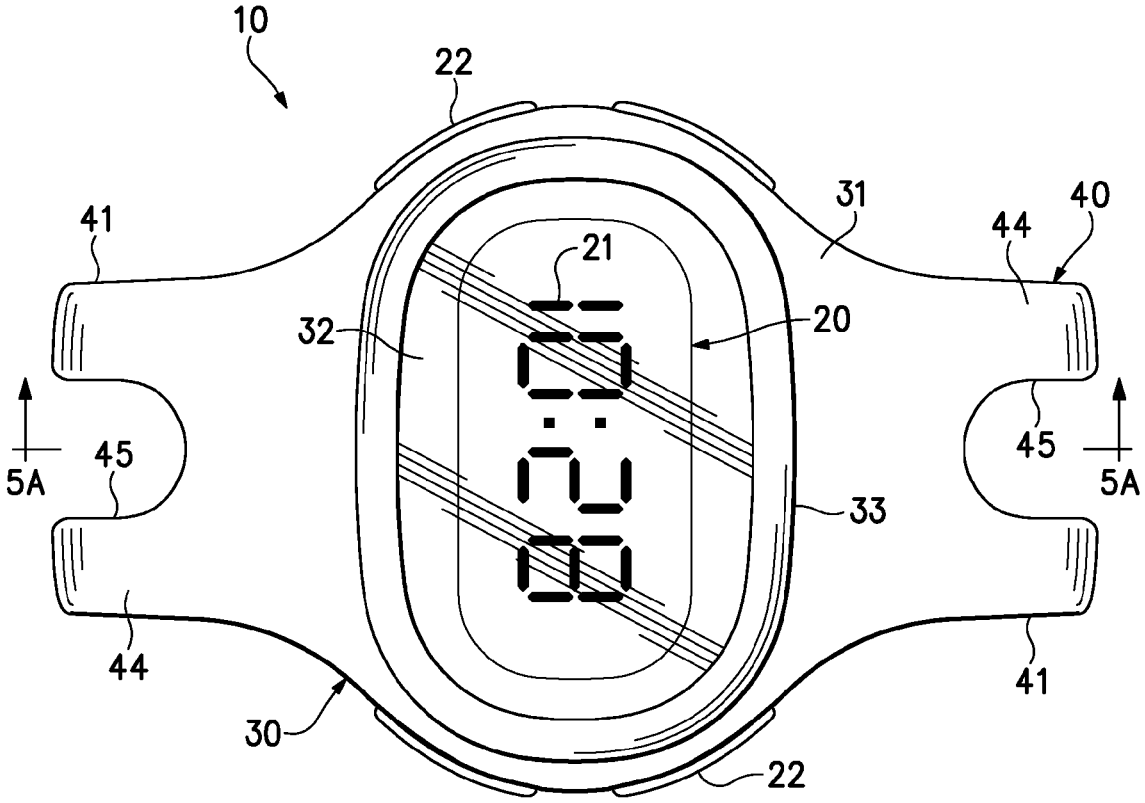
FIG. 2 is a top plan view of the timepiece.
Figure 3:
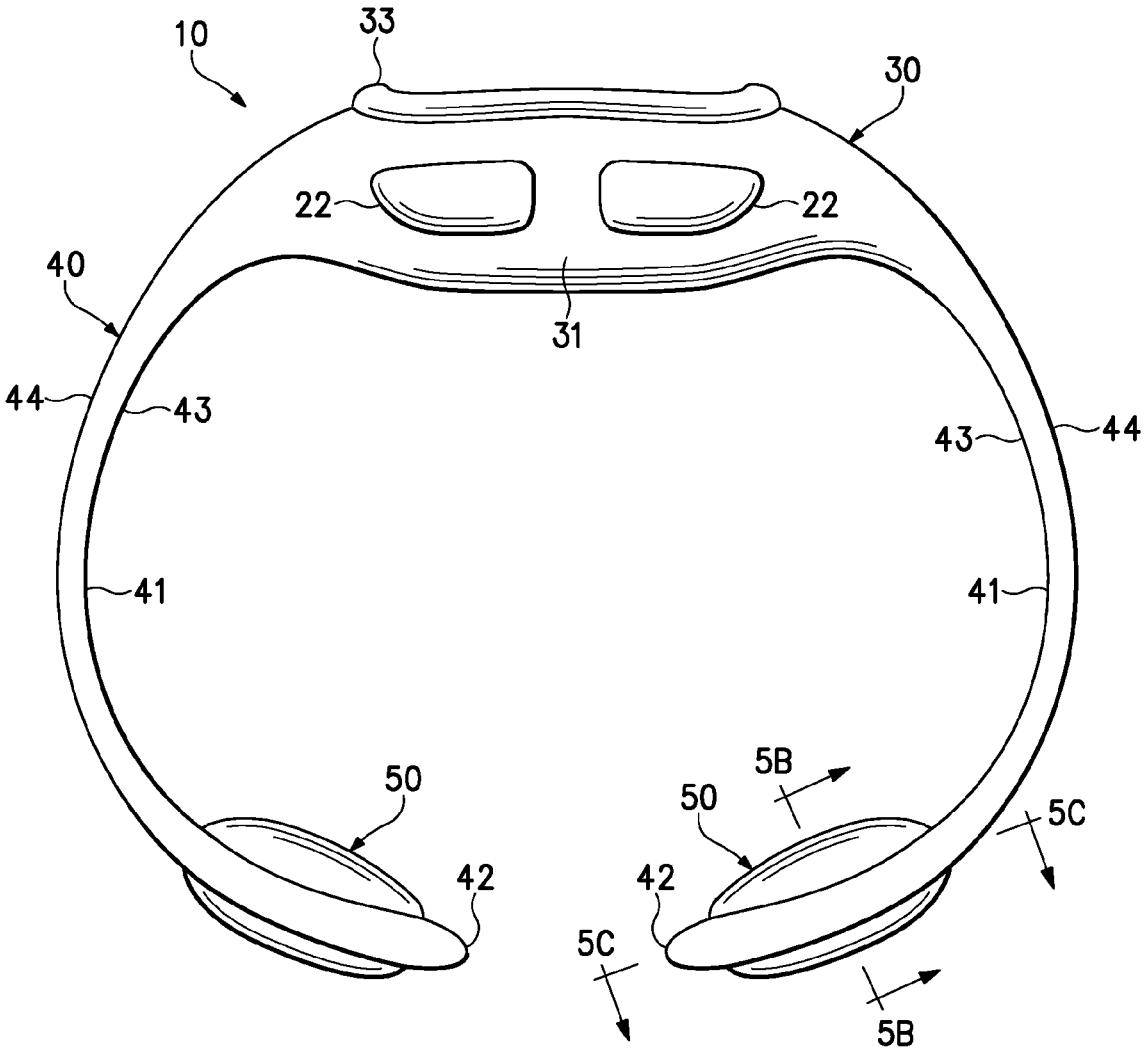
FIG. 3 is a first side elevational view of the timepiece.
Figure 4:
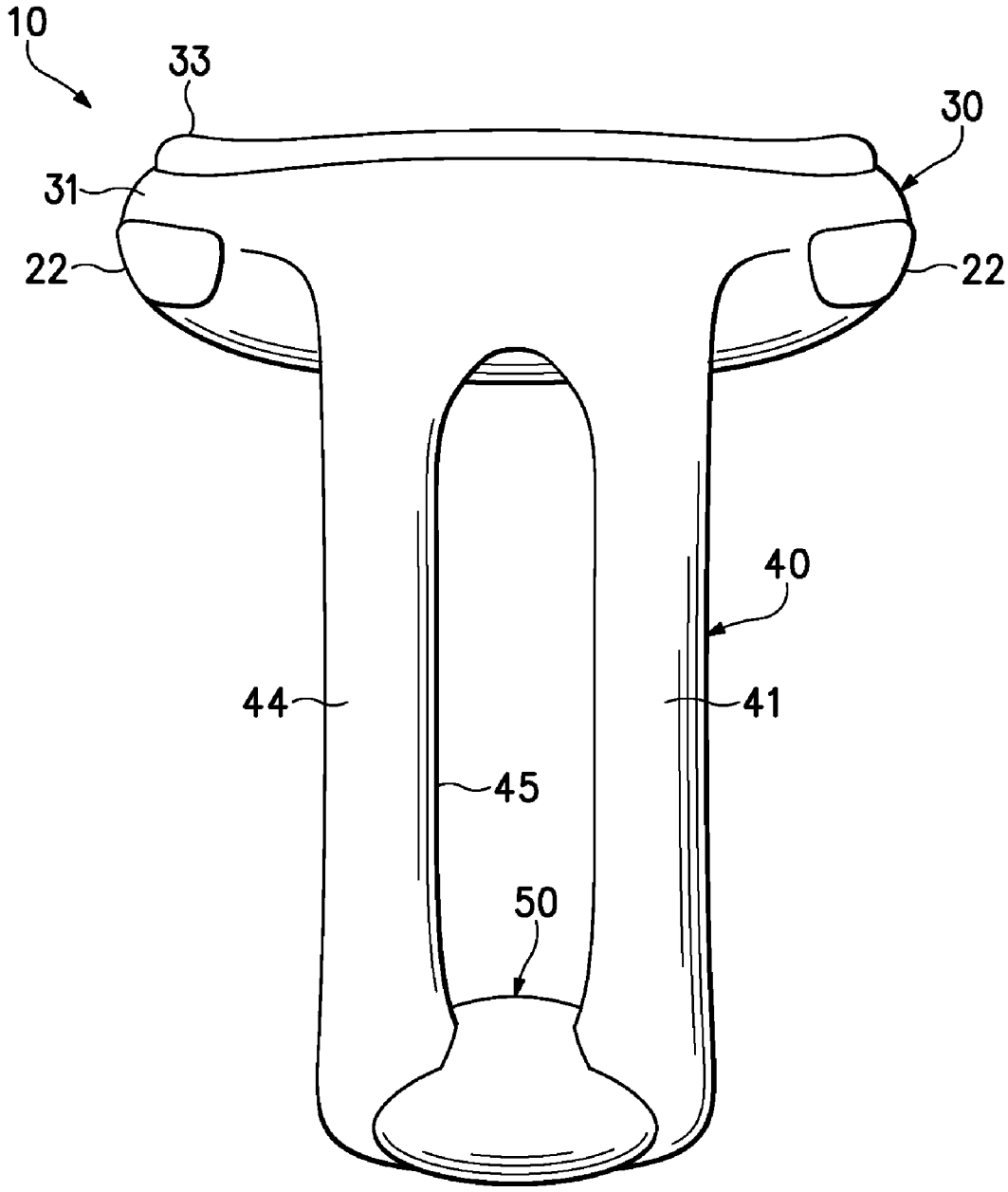
FIG. 4 is a second side elevational view of the timepiece.

The following discussion and accompanying figures disclose a wrist-worn timepiece 10 (i.e., a watch) with a wristband that includes semi-permanently secured contact elements. Timepiece 10 is depicted as having a configuration of a sport watch that is suitable for use during athletic training sessions or various athletic competitions. Concepts associated with timepiece 10 are not limited to timepieces with the configurations of sport watches, however, and may be incorporated into a variety of dress watches, diving watches, and causal watches, for example. Accordingly, the various concepts disclosed with regard to timepiece 10 apply to a wide variety of watch styles.

Timepiece Configuration

Referring to FIGS. 1-4, the primary elements of timepiece 10 are a timing element 20, a case 30, and a wristband 40. Timing element 20 is located within case 30 and includes a display 21 that visually displays the time or other information. Although display 21 is depicted as having a digital configuration, display 21 may also have an analog configuration depending upon whether timing element 20 incorporates electrical, mechanical, or a combination of mechanical and electrical components. In addition to tracking the time and displaying the time on display 21, timing element 20 may function as a chronograph, count-down timer, alarm, lap counter, calculator, thermometer, heart-rate monitor, altimeter, or global positioning system device, for example. In order to adjust the time and utilize these functions, timing element 20 includes various depressible buttons 22 that extend outward from case 30. Accordingly, the configuration of timing element 20 and the functions that timing element 20 imparts to timepiece 10 may vary significantly.

Case 30 provides a protective housing for timing element 20, thereby shielding timing element 20 from external forces and substantially preventing water or other liquids from interfering with the operation of timing element 20. The primary elements of case 30 are a body 31, a crystal 32, and a bezel 33. Body 31 forms a majority of case 30 and defines a depression that receives timing element 20 and crystal 32. In addition, body 31 defines another depression that extends around crystal 32 and receives bezel 33. Although body 31 is depicted as having a generally rounded and elliptical shape, body 31 may also exhibit a circular, square, rectangular, trapezoidal, hexagonal, or variety of other geometric or non-geometric shapes. Body 31 or portions of body 31 may be formed from a variety of polymer materials and metal materials.

Crystal 32 has an at least partially transparent configuration that provides visual access to display 21 of timing element 20. That is, display 21 may be viewed through crystal 32. As noted above, body 31 defines a depression that receives timing element 20 and crystal 32. When timepiece 10 is assembled, timing element 20 and crystal 42 are adjacent to each other and may be in contact with each other. Crystal 32 may be formed from a variety of at least partially transparent materials, including polymers, glass, and sapphire crystal, for example.

Bezel 33 has the configuration of a ring that extends around crystal 32. In addition to providing protection to an edge of crystal 32 and enhancing the overall aesthetic aspects of timepiece 10, bezel 33 may provide stability to case 30. More particularly, body 31 may be formed from a polymer material and bezel 33 may be formed from a metal material. When crystal 32 is inserted into body 31, the edges of crystal 32 may contact and press outward upon body 31, which may tend to warp or bend the relatively deformable material forming body 31. The presence of bezel 33, which may be formed from a less deformable material (e.g., metal), may limit or otherwise counteract the tendency of body 31 to warp or bend when crystal 32 is inserted. Furthermore, the relatively stable bezel 33 may limit the degree to which case 30 warps or bends during the use of timepiece 10 (i.e., when timepiece 10 is worn or when wristband 40 is flexed).

Wristband 40 is utilized to secure timepiece 10 to a wrist of a wearer and has an open, bracelet-type configuration. More particularly, wristband 40 includes two extensions 41 that extend outward from opposite sides of case 30 to wrap around opposite sides of the wrist. Although extensions 41 are depicted as being formed of unitary (i.e., one piece) construction with body 31, extensions 41 may be formed separately and joined with body 31 in some configurations of timepiece 10. Each of extensions 41 have an end 42 that is positioned opposite case 30 and defines a space or gap in wristband 40. Each of extensions 41 also have an interior surface 43 and an opposite exterior surface 44. When placing timepiece 10 upon the wrist or removing timepiece 10 from the wrist, extensions 41 may be flexed outward to increase the space between ends 42 and permit the wrist to pass through the space defined by ends 42. Extensions 41 are then released to decrease the space defined by ends 42 and place interior surface 43 adjacent to or in contact with the wrist. A timepiece having a similar bracelet-type configuration is disclosed in U.S. Pat. Nos. 6,857,775 and 7,114,845 to Wilson. Extensions 41 also define a pair of apertures 45 that extend between surfaces 43 and 44 and along a majority of a length of each of extensions 41. As depicted in FIGS. 1-5C, a pair of contact elements 50 are positioned within apertures 45 and adjacent to ends 42 to assist with securing timepiece 10 to the wrist. More particularly, contact elements 50 provide points of contact between timepiece 10 and the wrist and may hold interior surface 43 of extensions 41 away from (i.e., in a spaced relationship with) the wrist. In addition, contact elements 50 may be textured or formed from a material that limits slipping or other movement between timepiece 10 and the wrist.

Although a variety of materials may be utilized for extensions 41, a plurality of polymer materials may be sufficiently rigid to hold timepiece 10 upon the wrist and sufficiently flexible to permit extensions 41 to flex outward when placing timepiece 10 upon the wrist or removing timepiece 10 from the wrist. Suitable polymer materials for extensions 41 include, for example, acrylic, nylon, polycarbonate, polyethylene, polystyrene, polyurethane, polyester, and a polyester-polycarbonate blend. In addition to polymer materials, extensions 41 may be formed from a variety of metal materials, including steel, aluminum, titanium, brass, silver, or gold.

Contact Element Configuration

Contact elements 50 are semi-permanently secured within apertures 45. As discussed in greater detail below, contact elements 50 and the configuration of extensions 51 are selected such that contact elements 50 may not be easily separated from a remainder of timepiece 10. An advantage of this configuration is that contact elements 50 are less likely to be inadvertently removed from timepiece 10 during the lifespan of timepiece 10. That is, contact elements are securely positioned within apertures 45 and may not be removed due to wear or non-destructive actions of the wearer. If one or both of contact elements 50 are worn or damaged, however, then contact elements 50 may be deformed or further damaged in order to be removed. In further configurations of timepiece 10, however, contact elements 50 and the configuration of extensions 51 may be selected such that contact elements 50 are freely separable from the remainder of timepiece 10.

Figure 6A:
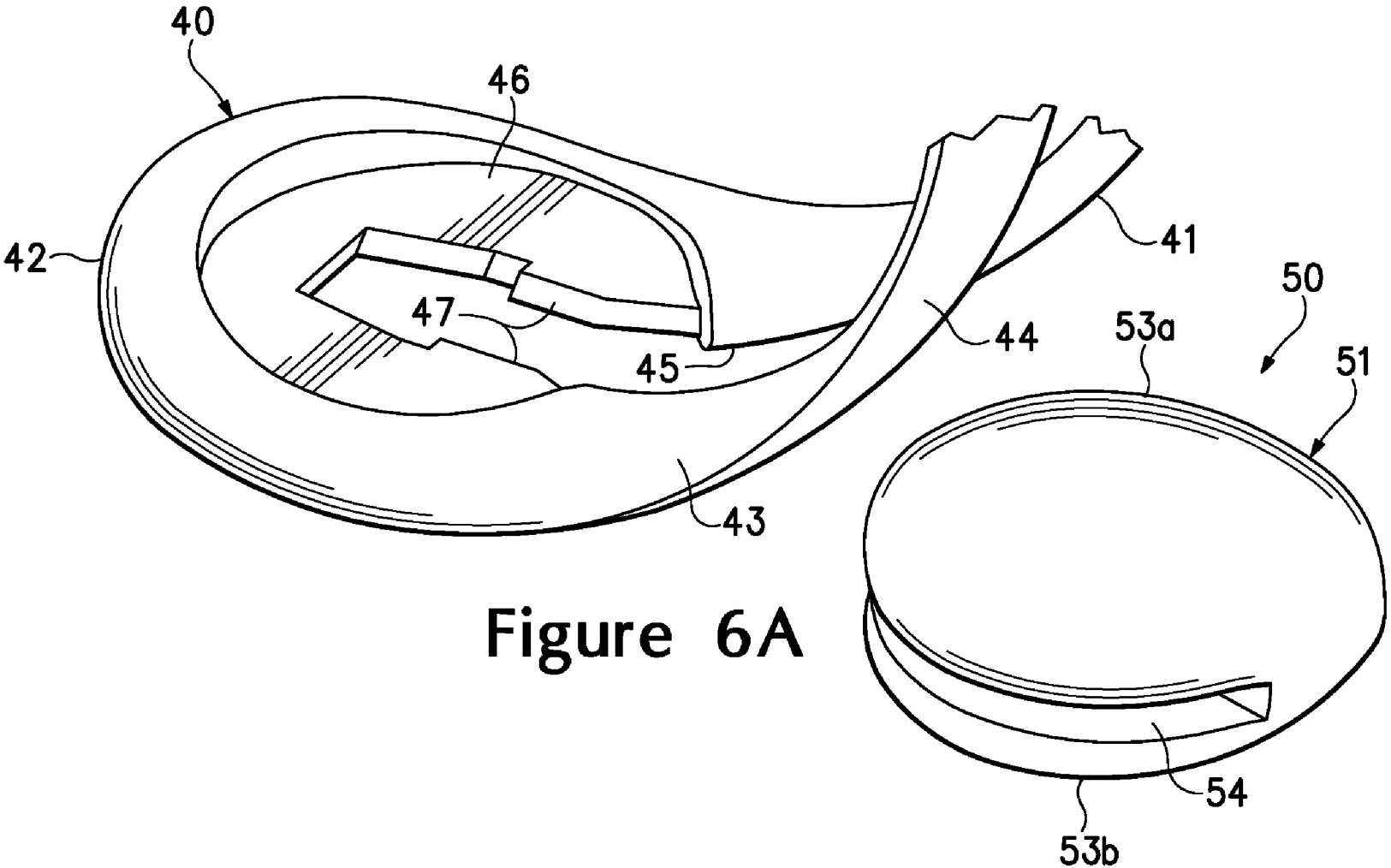
FIGS. 6A and 6B are exploded perspective views of a portion of a wristband of the timepiece.
Figure 6B:
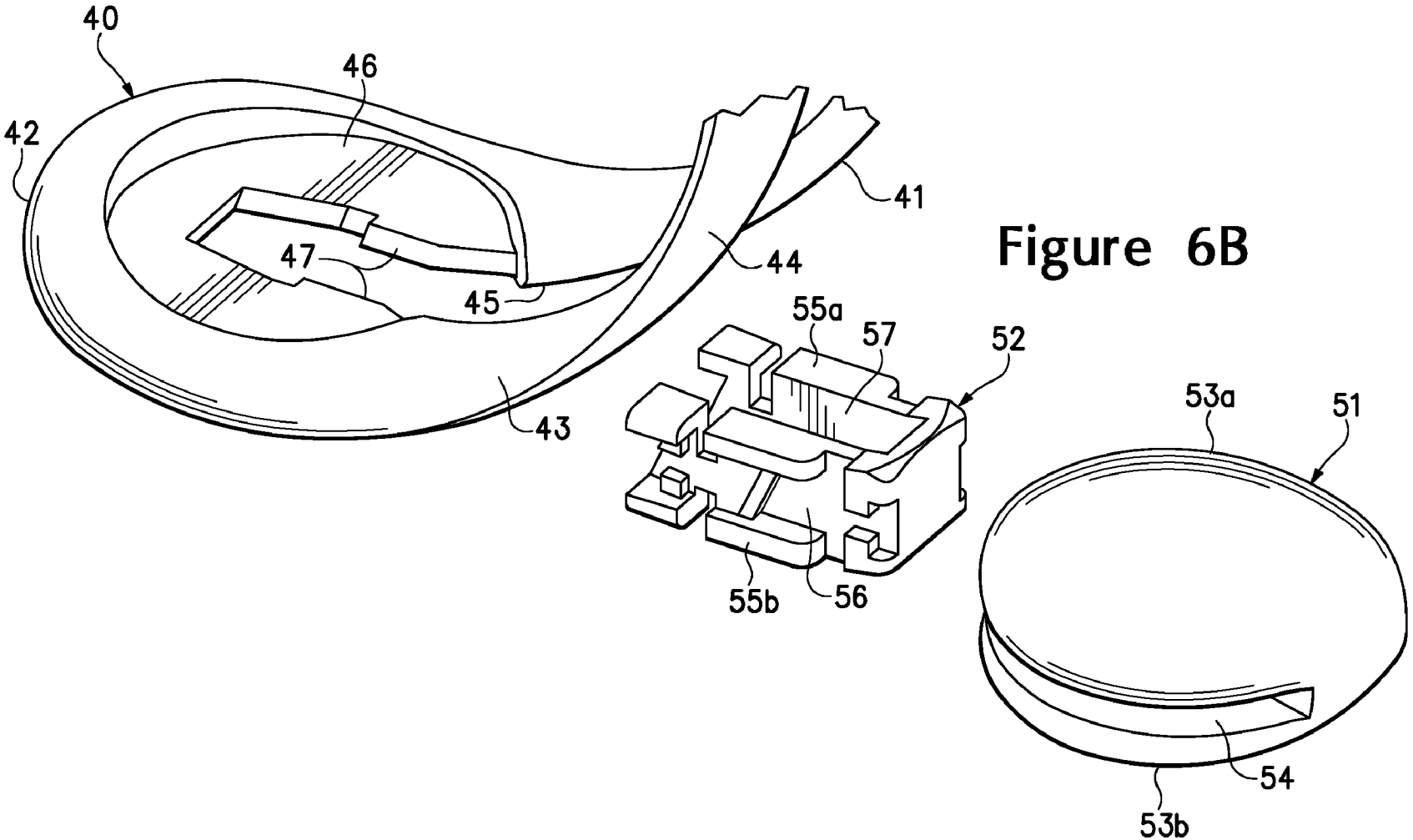
Figure 7:
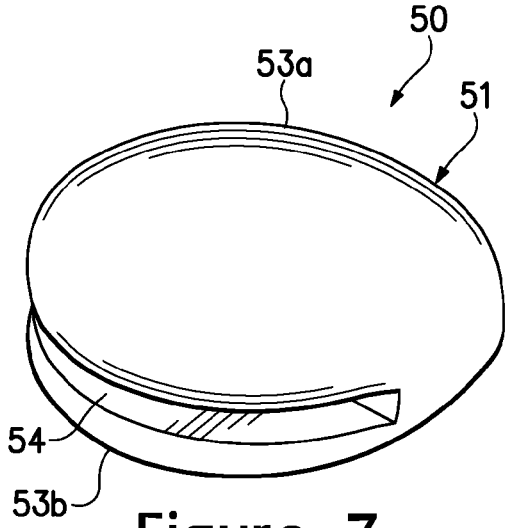
FIG. 7 is a perspective view of a contact element of the wristband.
Figure 8:
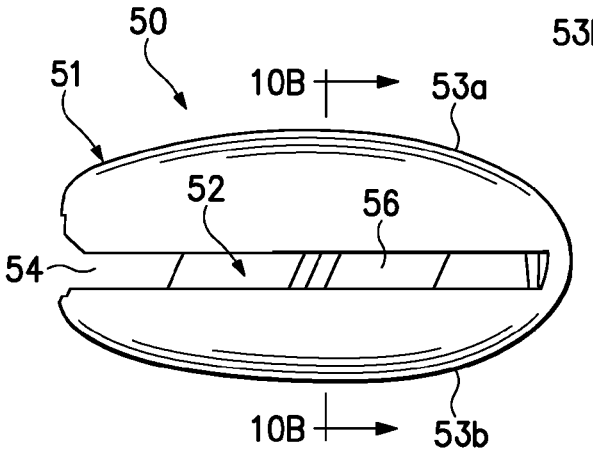
FIG. 8 is a first side elevational view of the contact element.
Figure 9:
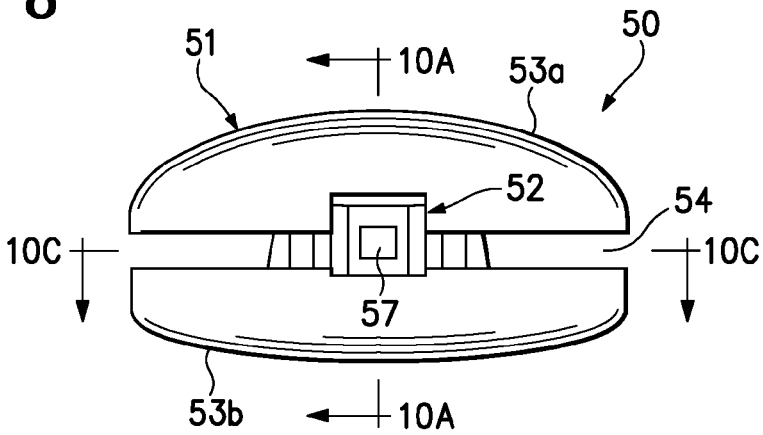
FIG. 9 is a second side elevational view of the contact element.

With reference to FIGS. 6A and 6B, one of contact elements 50 is depicted as being separate from one of extensions 41. The primary components of contact element 50 are an outer portion 51 and a locking portion 52. Outer portion 51 forms a portion of an exterior surface of timepiece 10 and is recessed into a pair of depressions 46 in opposite sides of extension 41 (i.e., in surfaces 43 and 44) when joined with extension 41. That is, opposite sides of outer portion 51 extend into depressions 46 and also protrude outward from depressions 46. Locking portion 52 is located within outer portion 51 and interfaces with an edge surface of aperture 45 to securely join contact element 50 with extension 41. More particularly, locking portion 52 is seated within an end of aperture 45 (i.e., adjacent to end 42) and adjacent to a pair of protrusions 47 that extend outward from opposite sides of aperture 45. In general, the configuration of protrusions 47 and the corresponding configuration of locking portion 52 securely join contact element 50 with extension 41.

One of contact elements 50 is depicted individually in FIGS. 7-11. Outer portion 51 includes an upper part 53*a* and an opposite lower part 53*b*. Each of parts 53*a* and 53*b* exhibit a generally rounded configuration. More particularly, an outline of parts 53*a* and 53*b* have a generally circular shape that fits within depressions 46, but may have a variety of shapes, and upper and lower surfaces of parts 53*a* and 53*b* are also generally curved to enhance comfort. A space 54, which separates parts 53*a* and 53*b*, receives extension 41 when contact element 50 is joined with a remainder of timepiece 10. That is, extension 41 is located within space 54 such that interior surface 43 is adjacent to and contacts upper part 53*a* and exterior surface 44 is adjacent to and contacts lower part 53*b*.

Locking portion 52 is embedded within outer portion 51 and includes an upper area 55*a* and an opposite lower area 55*b*. Upper area 55*a* is at least partially embedded or otherwise joined to upper part 54*a*, and lower area 55*b* is at least partially embedded or otherwise joined to lower part 54*b*. In this configuration, locking portion 52 extends across space 54 and is exposed within space 54. As noted above, space 54 receives extension 41 when contact element 50 is joined with a remainder of timepiece 10. Extension 41, therefore, extends around locking portion 52 when contact element 50 is joined with the remainder of timepiece 10. More particularly, locking portion 52 is located within aperture 45 when contact element 50 is joined with timepiece 10, and exposed surfaces of locking portion 52 contact an edge surface of aperture 45.

Figure 5A:
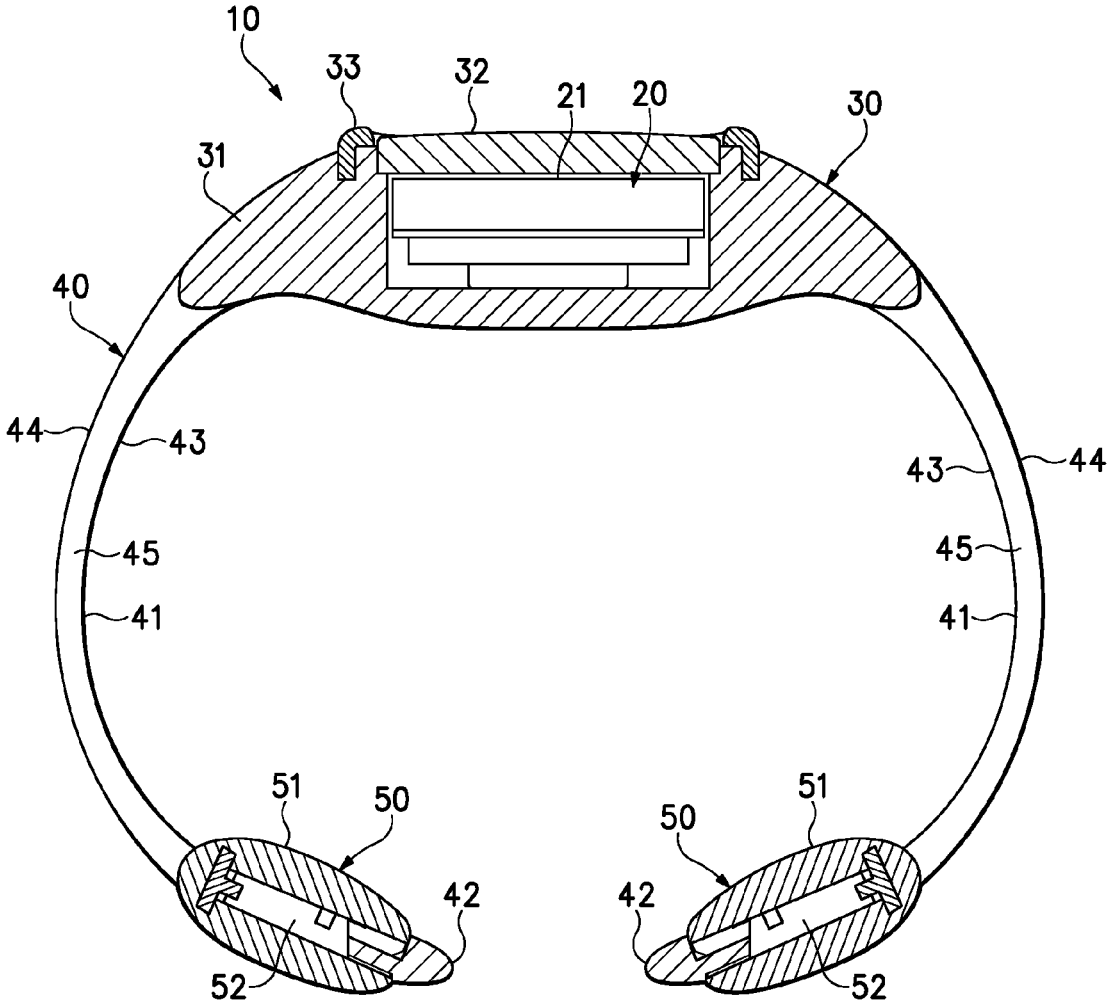
FIGS. 5A-5C are cross-sectional views of the timepiece, as defined by section lines 5A-5C in FIGS. 2 and 3.
Figure 5B:
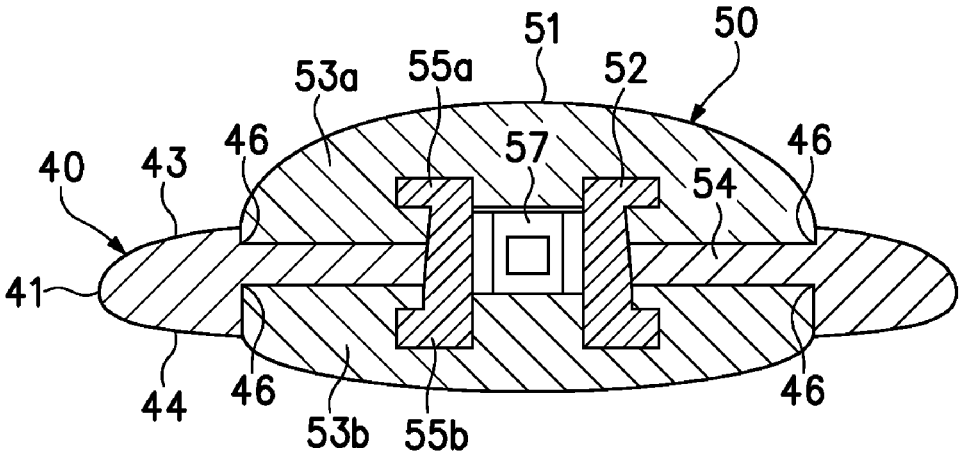
Figure 5C:
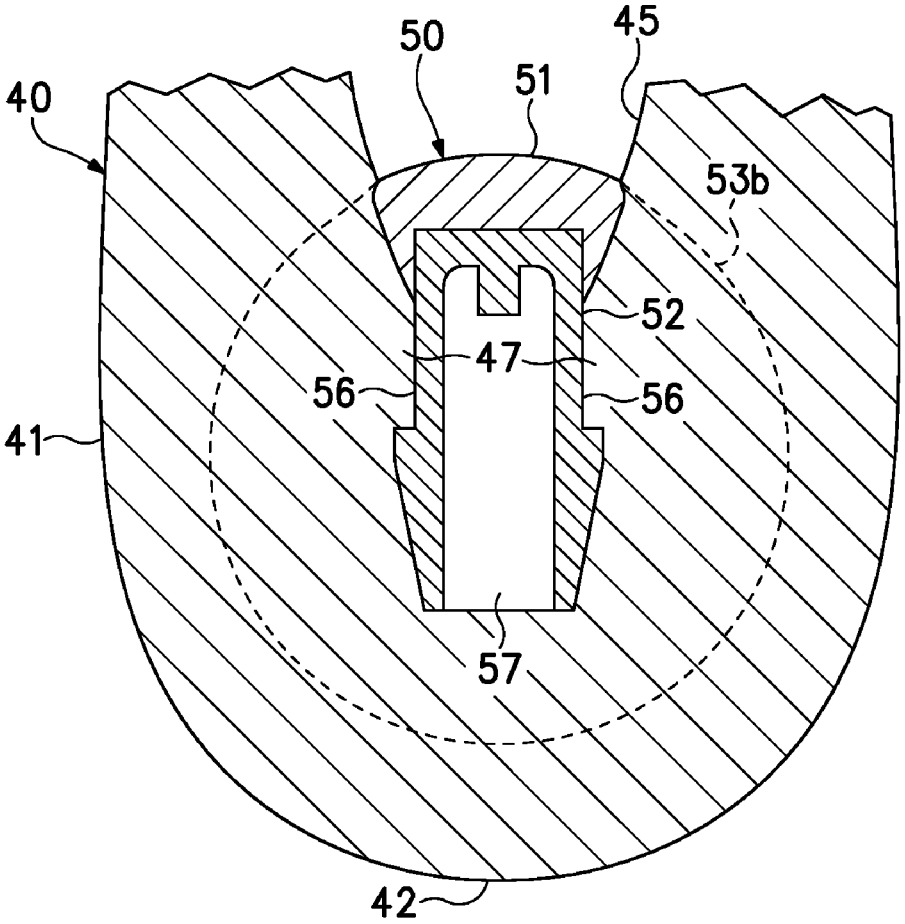
Figure 10A:
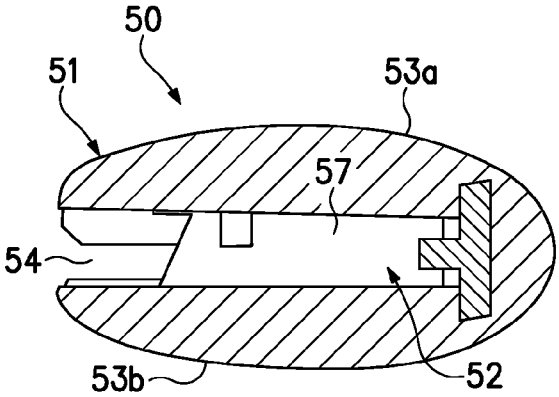
FIGS. 10A-10C are cross-sectional views of the contact element, as defined by section lines 10A-10C in FIGS. 8 and 9.
Figure 10C:
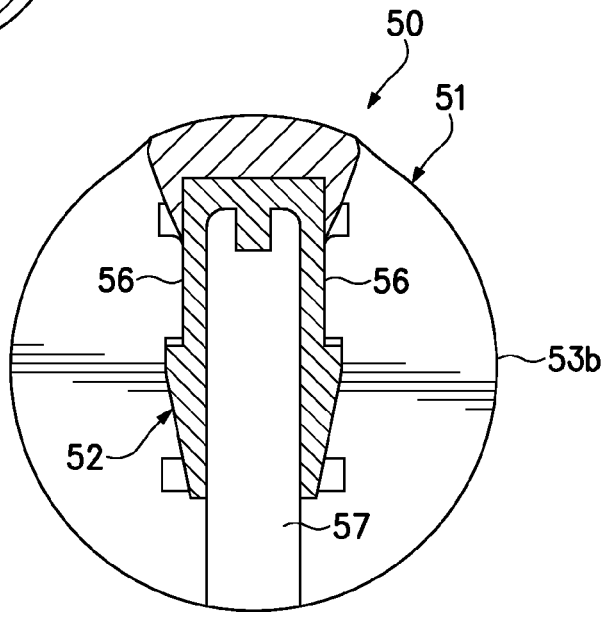
Figure 10B:
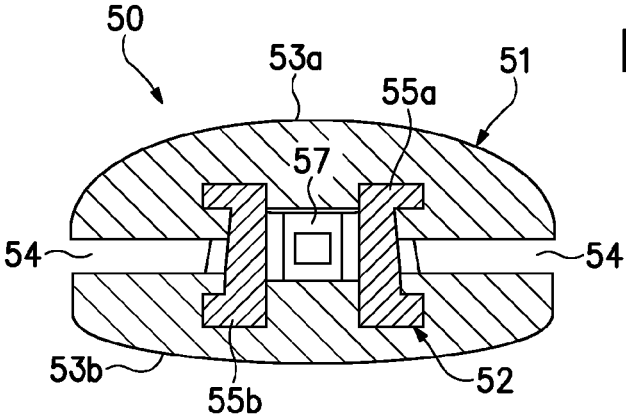
Figure 11:
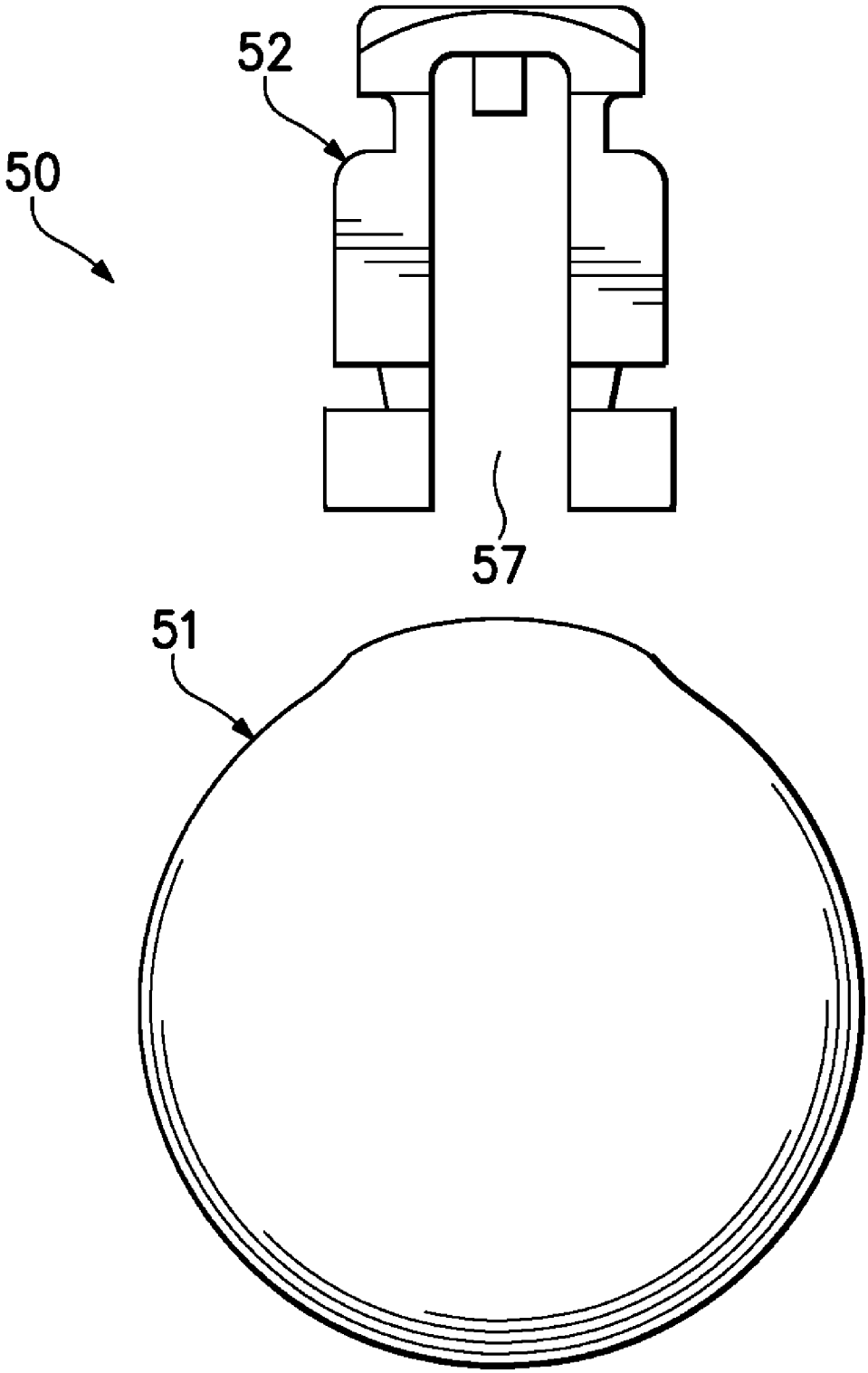
FIG. 11 is a top plan view of elements forming the contact element.

The portion of aperture 45 adjacent to end 42 has a generally arrow-shaped configuration, as depicted in FIGS. 5C and 6A, due to the presence of protrusions 47. Similarly, the exposed surfaces (i.e., the side surfaces) of locking portion 52 also have a generally arrow-shaped configuration due to the presence of a pair of indentations 56 in the exposed surfaces of locking portion 52, as depicted in FIGS. 5C, 6B, and 10C. When joined, therefore, locking portion 52 fits within the portion of aperture 45 adjacent to end 42. Furthermore, protrusions 47 extend into indentations 56 in order to lock or otherwise semi-permanently secure contact element 50 within aperture 45.

A central section of locking portion 52 defines an central area 57 between the side surfaces of locking portion 52. Central area 57 permits the side surfaces of locking portion 52 to deflect inward when joining contact element 50 with extension 41. That is, a relatively narrow front area of locking portion 52 extends between protrusions 47 of extension 41, which causes the side surfaces of locking portion 52 to deflect inward. As contact element 50 is pressed further into aperture 45, protrusions 47 extend into indentations 56 and the side surfaces of locking portion 52 return to an undeflected configuration. Although the material forming outer portion 51 is depicted as being absent from central area 57, the material of outer portion 51 may extend into central area 57 in some configurations of timepiece 10.

Outer portion 51 and locking portion 52 are depicted as being two separate elements that are joined together. In manufacturing contact element 50, locking portion 52 may be molded from a first material, locking portion 52 may be placed within a mold having the shape of contact element 50, and then a second material may be injected into the mold to form outer portion 51. That is, outer portion 51 may be molded around locking portion 52 to embed areas 55*a* and 55*b* of locking portion 52 within parts 53*a* and 53*b* of outer portion 51. An advantage of this process is that outer portion 51 and locking portion 52 may be formed from different materials with different properties. For example, locking portion 52 may be formed from a first material that has greater stiffness and greater hardness than a second material forming outer portion 51. The greater stiffness and hardness of locking portion 52 provides a durable interface between contact element 50 and extension 41 and also decreases the ease with which contact element 50 may be removed from aperture 45. Conversely, the lesser stiffness and hardness of outer portion 51 provides a comfortable surface for contacting the wrist and may also impart non-slip properties that limit inadvertent movement of timepiece 10 relative to the wrist. In some configurations of timepiece 10, however, contact element 50 may be formed from a singe element and a single material.

Based upon the above discussion, suitable polymer materials for locking portion 52 include acrylic, acrylonitrile butadiene styrene, nylon, polycarbonate, polyethylene, polystyrene, polyurethane, polyester, a polyester-polycarbonate blend, or other blends of these materials. Metal materials may also be utilized for locking portion 52, including steel, aluminum, titanium, brass, silver, or gold. In some configurations, the material forming locking portion 52 may be the same as the material forming extensions 41. Suitable polymer materials for outer portion 51 include rubber and various polymer foams (e.g., ethylvinylacetate and polyurethane foam).

Based upon the above discussion, contact elements 50 are positioned within apertures 45 and adjacent to ends 42 to assist with securing timepiece 10 to the wrist. More particularly, contact elements 50 provide points of contact between timepiece 10 and the wrist and may hold interior surface 43 of wristband 40 away from (i.e., in a spaced relationship with) the wrist. In addition, contact elements 50 each include an outer portion 51 and a locking portion 52 formed from different materials.

Additional Contact Element Configurations

The configuration of contact element 50 discussed above and depicted in FIGS. 1-11 provides an example of a suitable structure. An example of another structure is depicted in FIGS. 12A-13B as a contact element 50' having an outer portion 51' and a locking portion 52'. In comparison with contact element 50, the structure of locking portion 52' is modified in contact element 50'. Locking portion 52' is embedded within outer portion 51' and includes an upper area 55*a*' and an opposite lower area 55*b*'. Areas 55*a*' and 55*b*' are at least partially embedded or otherwise joined to outer portion 51'. In this configuration, locking portion 52' extends across a space 54' formed by outer portion 51' and is exposed within space 54'. As with space 54, space 54' receives extension 41 when contact element 50' is joined with a remainder of timepiece 10. Extension 41, therefore, extends around locking portion 52' when contact element 50' is joined with the remainder of timepiece 10. More particularly, locking portion 52' is located within aperture 45 when contact element 50' is joined with the remainder of timepiece 10, and exposed surfaces of locking portion 52' contact an edge surface of aperture 45.

Figure 12A:
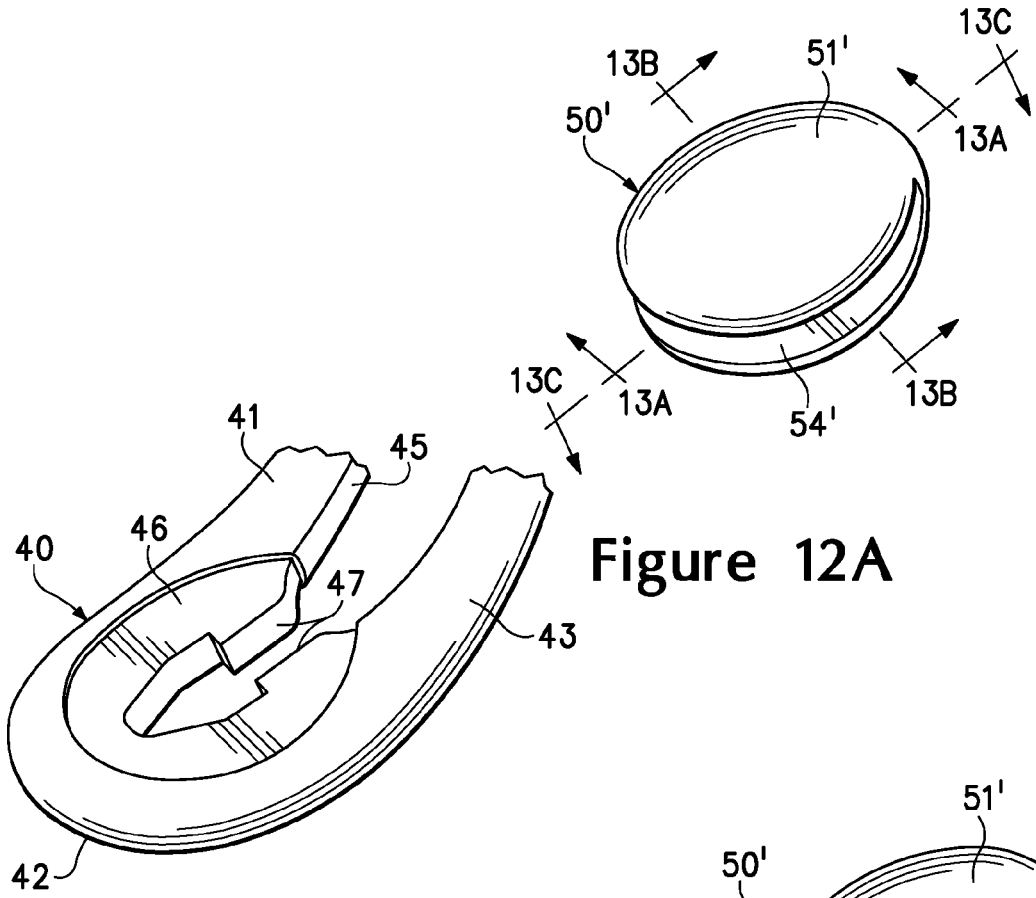
FIGS. 12A and 12B are exploded perspective views corresponding with FIGS. 6A and 6B and depicting another configuration of the contact element.
Figure 12B:
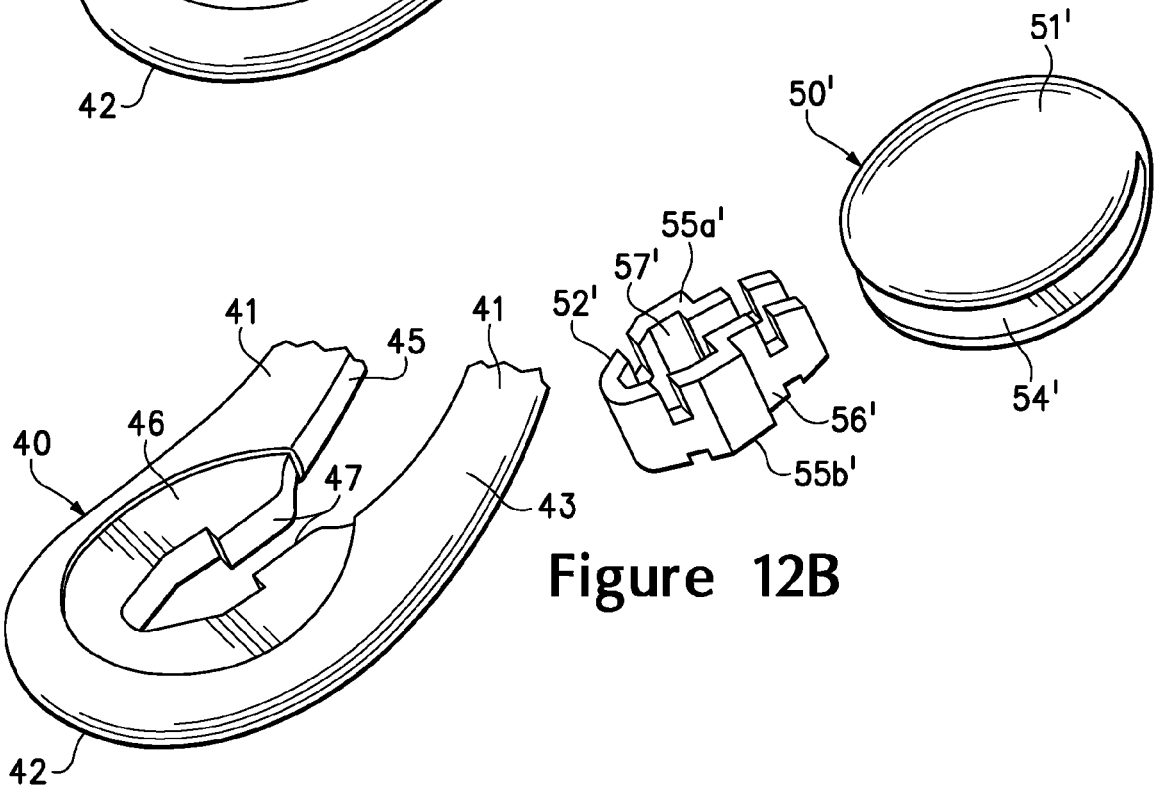
Figure 13A:
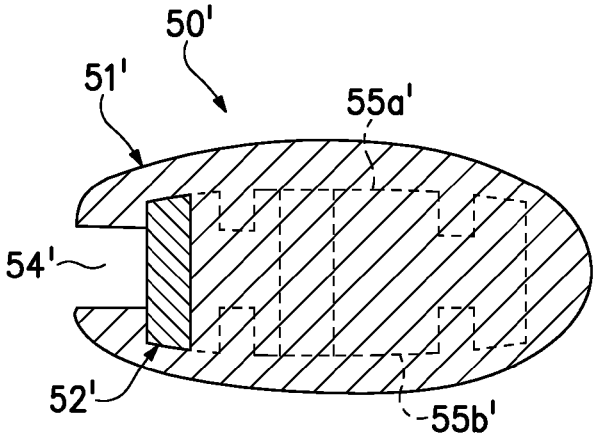
FIGS. 13A-13C are cross-sectional views of the contact element, as defined by section lines 13A-13C in FIG. 12A.
Figure 13C:
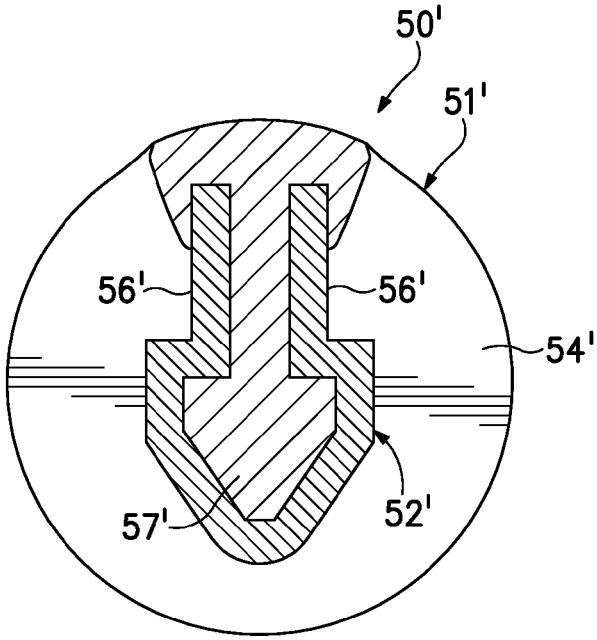
Figure 13B:
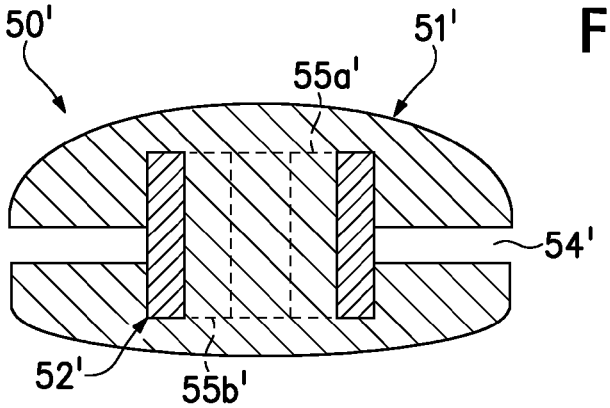

As with locking portion 52, the exposed surfaces (i.e., the side surfaces) of locking portion 52' have a generally arrow-shaped configuration due to the presence of a pair of indentations 56' in the exposed surfaces of locking portion 52', as depicted in FIGS. 12B and 13C. When joined, therefore, locking portion 52' fits within the portion of aperture 45 adjacent to end 42. Furthermore, protrusions 47 extend into indentations 56' in order to lock or otherwise semi-permanently secure contact element 50' within aperture 45.

A central section of locking portion 52' defines an central area 57' between the side surfaces of locking portion 52'. Central area 57' permits the side surfaces of locking portion 52' to deflect inward when joining contact element 50' with extension 41. In contrast with locking portion 52, central area 57' is depicted as including material from outer portion 51'. Although the material forming outer portion 51' is depicted as extending into central area 57', the material of outer portion 51' may be absent from central area 57' in some configurations of timepiece 10.

The general manufacturing method discussed above for contact element 50 may also be utilized in manufacturing contact element 50'. An advantage of this process is that outer portion 51' and locking portion 52' may be formed from different materials with different properties. For example, locking portion 52' may be formed from a first material that has greater stiffness and greater hardness than a second material forming outer portion 51'. The greater stiffness and hardness of locking portion 52' provides a durable interface between contact element 50' and extension 41 and also decreases the ease with which contact element 50' may be removed from aperture 45. Conversely, the lesser stiffness and hardness of outer portion 51' provides a comfortable surface for contacting the wrist and may also impart non-slip properties that limit inadvertent movement of timepiece 10 relative to the wrist. In some configurations of timepiece 10, however, contact element 50' may be formed from a singe element and a single material. Any of the materials discussed above for outer portion 51 and locking portion 52 may also be respectively utilized for outer portion 51' and locking portion 52'.

Figure 14A:
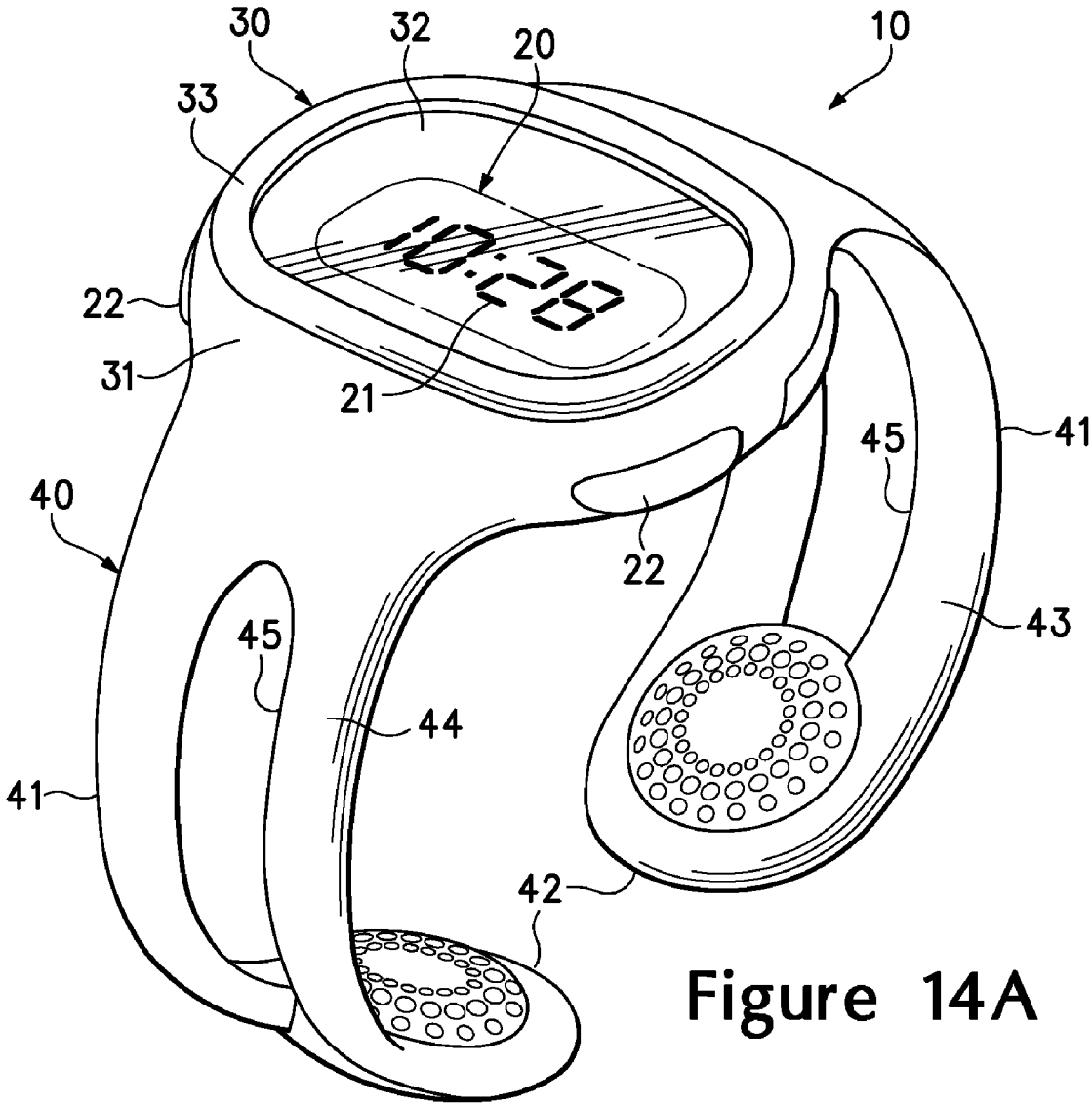
FIGS. 14A-14F are perspective views corresponding with FIG. 1 and depicting further configurations of the timepiece.
Figure 14B:
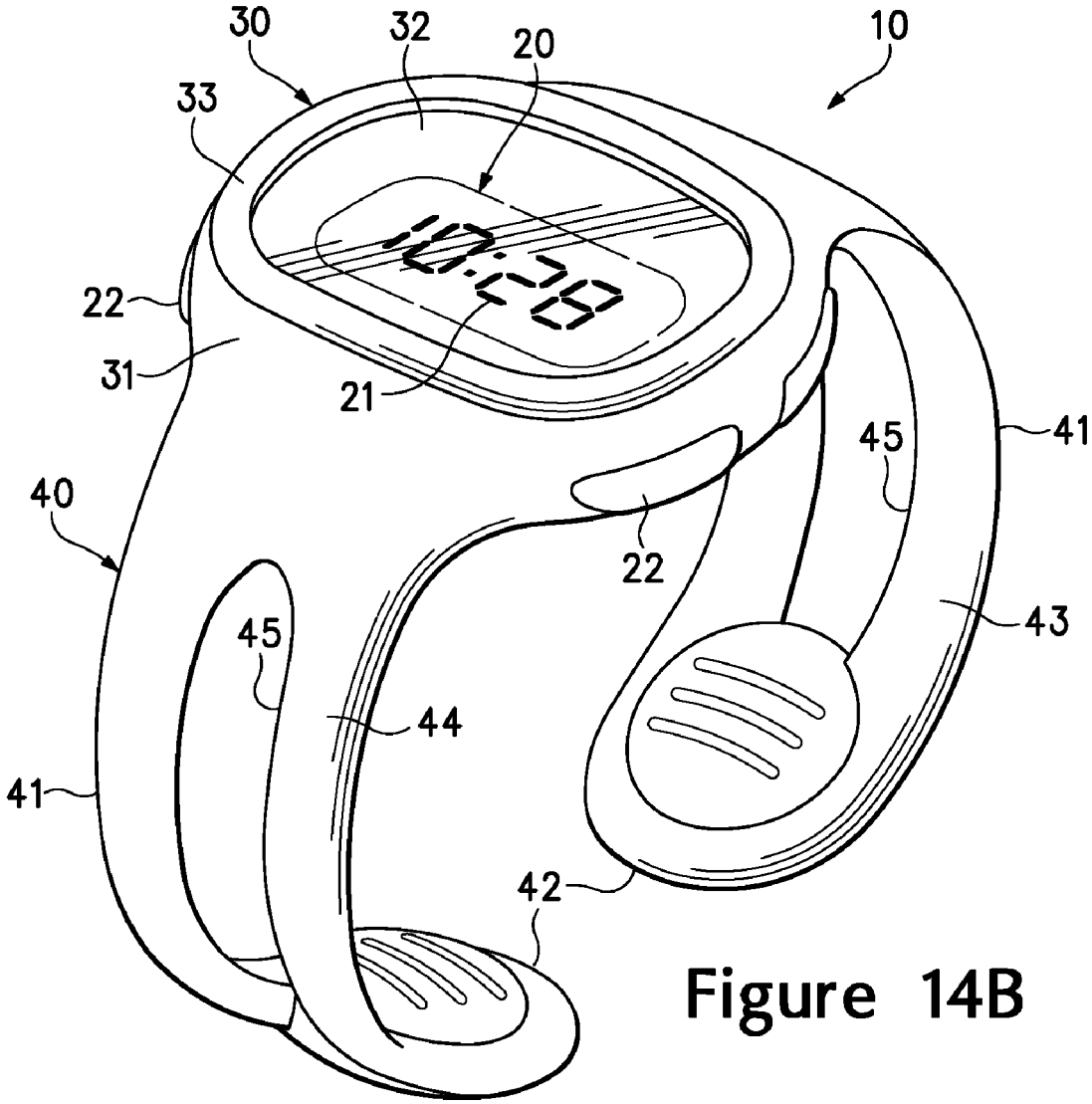
Figure 14C:
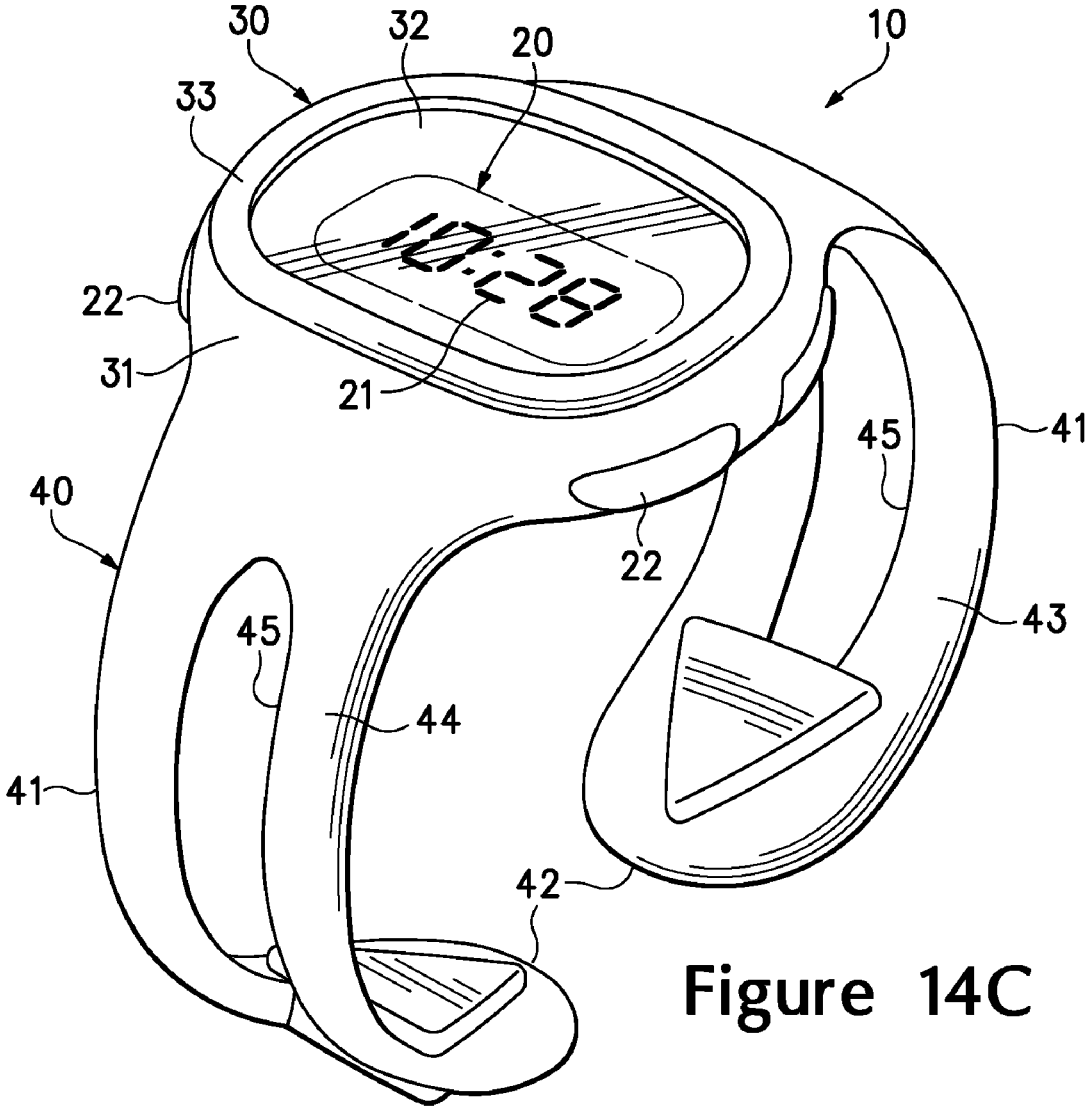
Figure 14D:
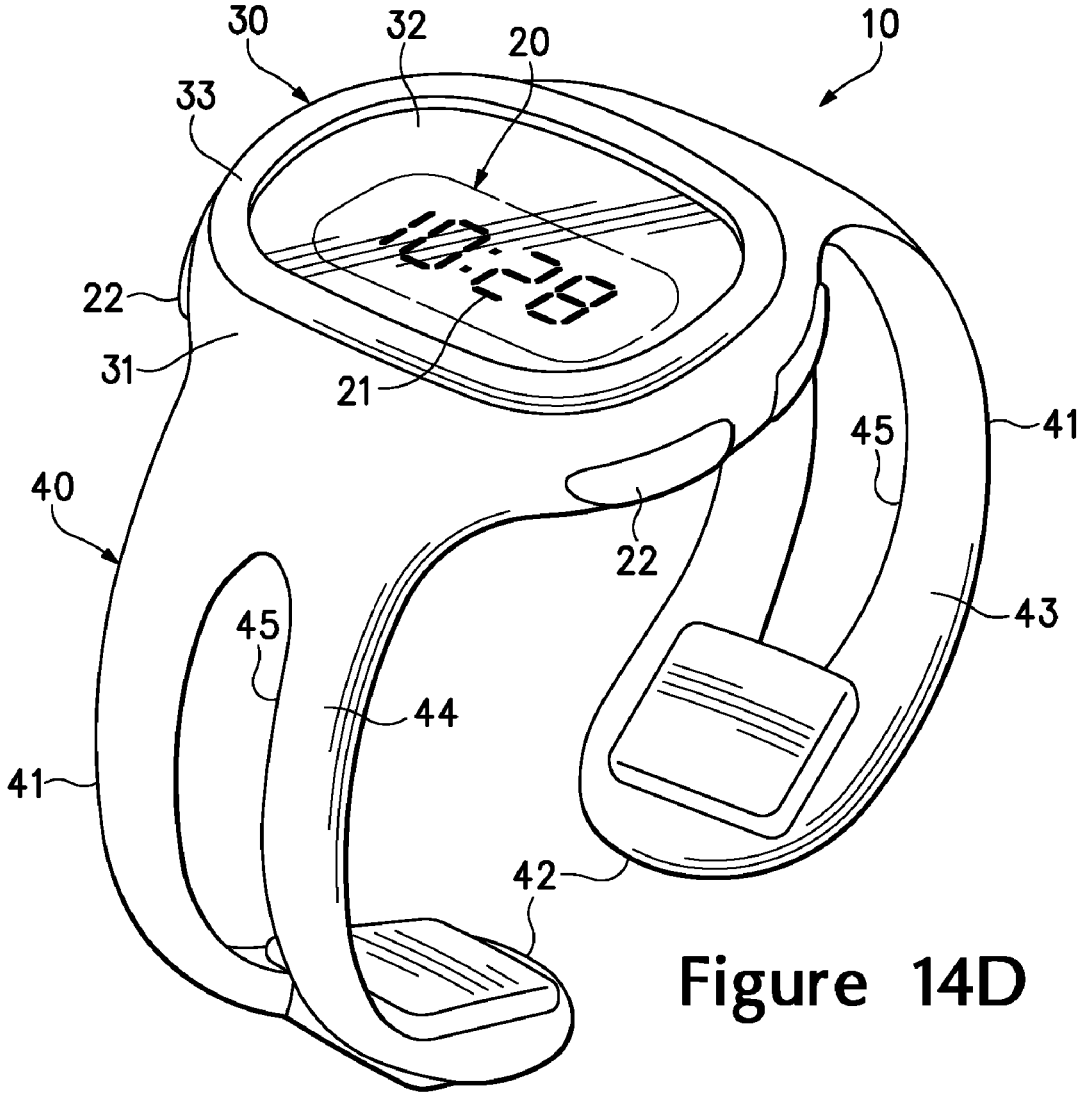
Figure 14E:
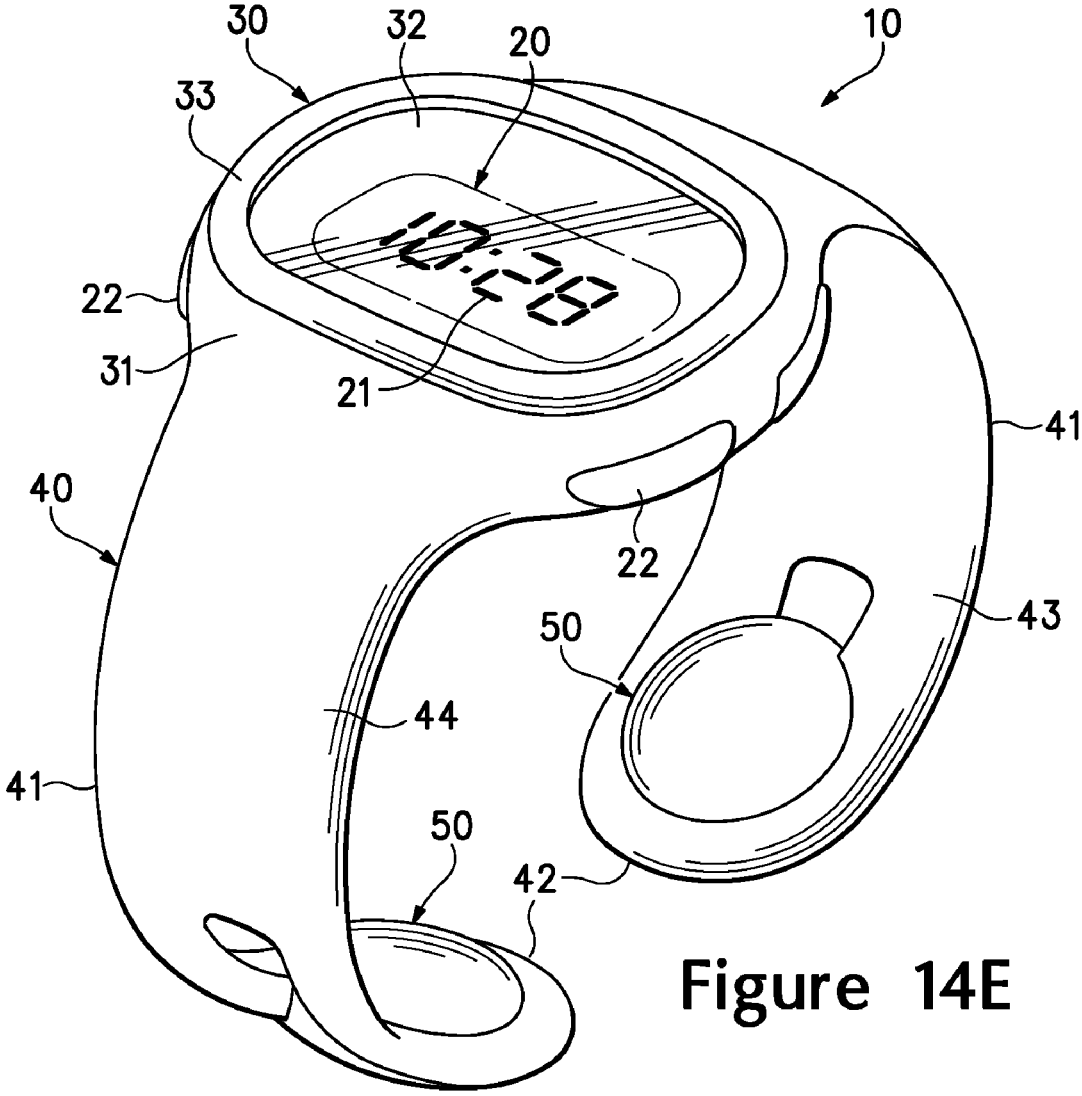
Figure 14F:
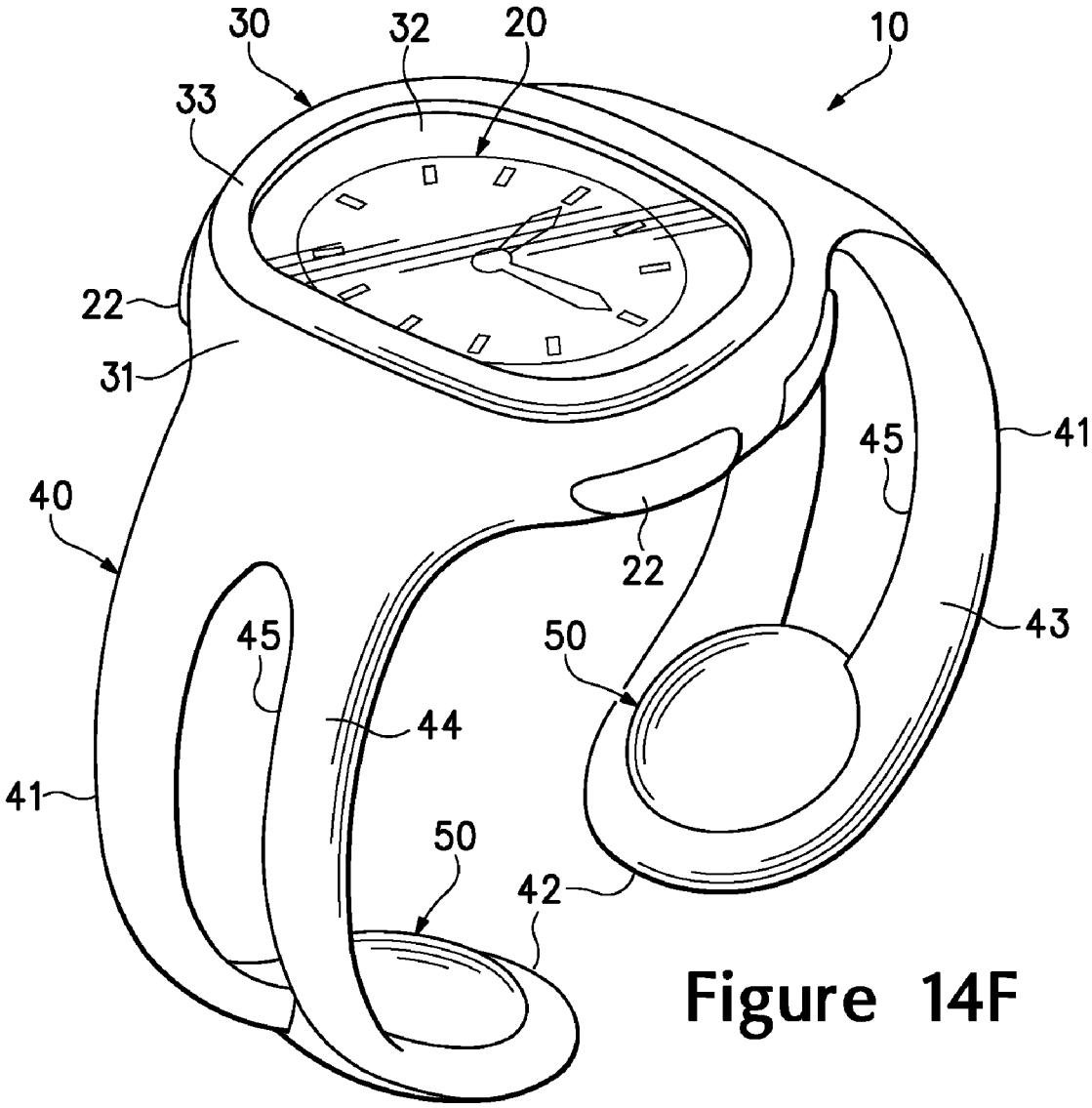

In further configurations, contact elements 50 may have a textured surface that provides additional non-slip properties to limit inadvertent movement of timepiece 10 relative to the wrist. For example, upper surfaces of contact elements 50 are depicted as having a plurality of protrusions in FIG. 14A, and the upper surfaces of contact elements 50 are depicted as having a plurality of linear indentations in FIG. 14B. In some configurations, contact elements 50 may have shapes other than circular. For example, contact elements 50 are depicted as having a triangular shape in FIG. 14C and a square shape in FIG. 14D, but may also have hexagonal, rectangular, or other geometric or non-geometric shapes. The configurations of other portions of timepiece 10 may also vary. For example, apertures 45 may be limited to an area proximal to ends 42, as depicted in FIG. 14E. Timing element may also have an analog configuration, as depicted in FIG. 14F. Accordingly, both timepiece 10 and contact elements 50 may have a variety of configurations.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A wrist-worn timepiece comprising:

a case a timing element located within the case;

a wristband extending outward from the case and formed of unitary construction with the case, the wristband having an end area opposite the case, the end area defining an aperture extending through the wristband and from a first surface to an opposite second surface of the wristband; and a contact element secured to the wristband, the contact element having:

an outer portion that forms a portion of an exterior surface of the timepiece and is located to contact a wrist of a wearer, the outer portion being formed of a first material, and the outer portion covering a portion of each of the first surface and the second surface, and a locking portion joined with the outer portion and positioned to contact an edge of the aperture, the locking portion being formed of a second material that is different from the first material.

2. The timepiece recited in claim 1, wherein a shape of the locking portion corresponds with a shape of a portion of the aperture.

3. The timepiece recited in claim 1, wherein the wristband includes at least one protrusion extending into the aperture, and the locking portion defines an indentation that receives the protrusion.

4. The timepiece recited in claim 1, wherein the wristband defines a depression located adjacent to the aperture, and the outer portion of the contact element is located within the depression.

5. The timepiece recited in claim 1, wherein the second material has greater stiffness than the first material.

6. A wrist-worn timepiece comprising:

a case a timing element located within the case;

a wristband that includes a first extension and a second extension extending outward from the case, the first extension and the second extension defining end areas that are opposite the case and are separated by a space, the first extension defining an aperture extending along a majority of a length of the first extension, at least a portion of the aperture being adjacent to the end area of the first extension, and the first extension defining a protrusion extending into the aperture at the end area; and a contact element at least partially located within the aperture, the contact element having:

an outer portion that forms a portion of an exterior surface of the timepiece and is located to contact a wrist of a wearer, the outer portion being formed of a first material, and a locking portion located entirely between opposite sides of the outer portion and positioned to contact an edge of the aperture, the locking portion defining an indentation that receives the protrusion, and the locking portion being formed of a second material, the second material having greater stiffness than the first material.

7. The timepiece recited in claim 6, wherein a shape of the locking portion corresponds with a shape of a portion of the aperture.

8. The timepiece recited in claim 6, wherein another contact element is located adjacent to the end area of the second extension.

9. The timepiece recited in claim 6, wherein the first extension defines a depression located adjacent to the aperture, and the outer portion of the contact element is located within the depression.

10. The timepiece recited in claim 6, wherein the aperture extends from a first surface to a second surface of the first extension, and the outer portion of the contact element extends outward from the aperture to cover a portion of each of the first surface and the second surface.

11. A wrist-worn timepiece comprising:

a case a timing element located within the case;

a wristband formed of unitary construction with the case, the wristband including a first extension and a second extension extending outward from the case, the first extension and the second extension defining end areas that are separated by a space, the first extension having:

a first surface oriented to contact a wrist of a wearer, a second surface located opposite the first surface and oriented to face away from the wrist, and an aperture extending through the end area of the first extension, the aperture having an edge surface extending from the first surface to the second surface, the edge surface defining a protrusion extending into the aperture; and a contact element secured to the wristband, the contact element having:

an outer portion having a first part that covers a portion of the first surface and a second part that covers a portion of the second surface, the outer portion being formed of a first material, and a locking portion located between the first part and the second part of the outer portion and positioned to contact the edge surface, the locking portion defining an indentation that receives the protrusion, and the locking portion being formed of a second material, the second material having greater stiffness than the first material.

12. The timepiece recited in claim 11, wherein another contact element is located adjacent to the end area of the second extension.

13. The timepiece recited in claim 11, wherein the first extension defines a depression located adjacent to the aperture, and one of the first part and the second part of the outer portion is located within the depression.

14. The timepiece recited in claim 11, wherein the locking portion is embedded within each of the first part and the second part of the outer portion.

15. The timepiece recited in claim 11, wherein the first extension is formed from the second material.

16. A wrist-worn timepiece comprising:

a case;

a timing element located within the case;

a wristband extending outward from the case and formed of unitary construction with the case, the wristband having an end area opposite the case, the end area defining an aperture extending through the wristband; and a contact element secured to the wristband, the contact element having:

an outer portion that forms a portion of an exterior surface of the timepiece and is located to contact a wrist of a wearer, the outer portion being formed of a first material, and a locking portion joined with the outer portion and positioned to contact an edge of the aperture, the locking portion being formed of a second material that is different from the first material, wherein a portion of the wristband that defines the aperture is formed from the second material.

17. The timepiece recited in claim 16, wherein a shape of the locking portion corresponds with a shape of a portion of the aperture.

18. The timepiece recited in claim 16, wherein the wristband includes at least one protrusion extending into the aperture, and the locking portion defines an indentation that receives the protrusion.

19. The timepiece recited in claim 16, wherein the wristband defines a depression located adjacent to the aperture, and the outer portion of the contact element is located within the depression.

20. The timepiece recited in claim 16, wherein the aperture extends from a first surface to a second surface of the wristband, and the outer portion of the contact element extends outward from the aperture to cover a portion of each of the first surface and the second surface.

21. The timepiece recited in claim 16, wherein the second material has greater stiffness than the first material.

22. A wrist-worn timepiece comprising:

a case;

a timing element located within the case;

a wristband extending outward from the case and formed of unitary construction with the case, the wristband having an end area opposite the case, the end area defining an aperture extending through the wristband; and a contact element secured to the wristband, the contact element having a two-part configuration consisting of:

an outer portion that forms a portion of an exterior surface of the timepiece and is located to contact a wrist of a wearer, the outer portion being formed of a first material, and a locking portion joined with the outer portion and positioned to contact an edge of the aperture, the locking portion being formed of a second material that is different from the first material.

23. The timepiece recited in claim 22, wherein a shape of the locking portion corresponds with a shape of a portion of the aperture.

24. The timepiece recited in claim 22, wherein the wristband includes at least one protrusion extending into the aperture, and the locking portion defines an indentation that receives the protrusion.

25. The timepiece recited in claim 22, wherein the wristband defines a depression located adjacent to the aperture, and the outer portion of the contact element is located within the depression.

26. The timepiece recited in claim 22, wherein the aperture extends from a first surface to a second surface of the wristband, and the outer portion of the contact element extends outward from the aperture to cover a portion of each of the first surface and the second surface.

27. The timepiece recited in claim 22, wherein the second material has greater stiffness than the first material.

* * * * *